US005321384A

United States Patent [19]

Siedle et al.

[11] Patent Number: 5,321,384

[45] Date of Patent: Jun. 14, 1994

[54] MOVABLE TAP OR WIPER FOR POTENTIOMETERS

[75] Inventors: Horst Siedle, Furtwangen; Wolfgang Leue, Abstatt, both of Fed. Rep. of Germany

[73] Assignee: Horst Siedle KG, Furtwangen, Fed. Rep. of Germany

[21] Appl. No.: 969,134

[22] Filed: Oct. 30, 1992

[30] Foreign Application Priority Data

Nov. 19, 1991 [DE] Fed. Rep. of Germany ..... 4137989

[51] Int. Cl.[5] ..... H01C 10/32; H01C 1/12

[52] U.S. Cl. ..... 338/171; 338/202

[58] Field of Search ..... 338/171, 160, 162, 170, 338/202

[56] References Cited

U.S. PATENT DOCUMENTS

| | | | |
|---|---|---|---|
| Re.31,431 | 10/1983 | Gass | 338/202 |
| 4,050,051 | 9/1977 | Kádár et al. | 338/171 X |
| 4,237,443 | 12/1980 | Gass | 338/202 |
| 4,511,879 | 4/1985 | Fujii | 338/174 |
| 4,572,599 | 2/1986 | Pryputniewicz et al. | 338/202 X |
| 4,706,062 | 11/1987 | Männle et al. | 338/172 |
| 4,719,795 | 1/1988 | Eitoku et al. | 338/171 X |
| 5,047,746 | 9/1991 | Stilwell et al. | 338/162 |

*Primary Examiner*—Marvin M. Lateef
*Attorney, Agent, or Firm*—Darby & Darby

[57] ABSTRACT

In connection with a movable tap for potentiometers, adjustable rheostats, or the like, it is proposed that movable separate wiper fingers, formed from small round wires, be arranged on a wiper finger carrier in parallel one to the other and in groups, with spacings provided between the groups of a width corresponding substantially to the width of the group, so that abraded matter and scuff can settle between the groups of wiper fingers without causing functional trouble.

6 Claims, 2 Drawing Sheets

MOVABLE TAP OR WIPER FOR POTENTIOMETERS

DESCRIPTION OF THE PRIOR ART

The present invention relates to a movable tap for rotary or linear potentiometers, adjustable rotary rheostats, or the like, preferably for rapidly-moving potentiometers for use in control technology, according to the preamble of claim 1.

A known tapping device of this kind (DE-PS 33 40 635) comprises a wiper made as a single piece from an electrically conductive resilient material and terminating, in the transitional area between the respective resistance or collector paths on which it slides, by a plurality of wiper fingers arranged in parallel one to the other.

It would also be possible in this case to design such a moving tap or wiper in such a way (DE-PS 27 06 760) that when a plurality of parallel wiper fingers are provided, which slide simultaneously along the path and which terminate and are supported by a common connection zone, a highly flexible elastomeric plastic material with high internal friction is applied on at least two opposite sides of the wiper fingers, which enables wiper finger movements to be effectively be damped, especially in the case of rapidly moving potentiometers. One thereby succeeds, in spite of the considerable unevenness of the surface of potentiometer resistance and collector paths on which the wiper fingers slide—that can be seen under the microscope —to ensure comparatively smooth oscillating movements of the wiper fingers so that any escalation of vibrations due to the resilient qualities necessarily existing with wipers, and the resulting rapid destruction can be avoided.

It further has been known in this connection to provide the fingers on a—preferably resilient—carrier element in close arrangement one beside the other, for example by fixing them on the resilient element for example by spot welding, which results in a certain degree of mechanical damping of the movements of the different wiper fingers one relative to the other, the adjacent and contacting surfaces of the individual wiper fingers, which extend in parallel one to the other, resulting in mechanical friction which, due to the statistical distribution of the wiper finger movements, ensure that in average the vibration behavior of the individual wiper fingers will be damped. Several embodiments of such wiper-finger pickoff systems, where small round wires are fixed on a further carrier in parallel arrangement by spot welding, are described for example by the leaflet PKV 20 from the Heraeus company entitled "Multi-wire wipers".

Nevertheless, their remains the problem with such pickoff systems that due to the relative movement between the wiper fingers and their runway, scuff or other abraded matter may be produced which in the long run will deposit on any surfaces, including the wiper fingers, which due to their immediately adjacent structure form a continuous surface so that problems may arise in the desired operational sequence.

ADVANTAGES OF THE INVENTION

The invention solves this problem with the aid of the features of claim 1 and provides for the abraded matter and scuff generated by the relative movement a space between the wiper fingers and their runway formed by the gaps between the wiper finger groups, where such scuff can settle without creating any problems or other disturbance.

Investigations have shown that this results in considerable improvements regarding the service life of such potentiometers, which are equipped with the wiper fingers according to the invention, while another advantage is derived from the fact that the number of wiper fingers is effectively reduced which leads to improvement in the cost structure as such wiper fingers are normally made from a noble metal.

The advantages of the present invention make themselves felt with both the known scraper-type wiper designs, where the bent-off point of the wiper finger slides on the runway, and with skid-type wipers, where the wiper fingers contact and slide on the resistance or collector path by their bending radius.

BRIEF DESCRIPTION OF THE DRAWINGS:

Certain embodiments of the invention will be described hereafter in more detail with reference to the drawing in which.

DESCRIPTION OF THE EMBODIMENTS

It is the basic idea of the present invention, in connection with a tap or wiper for a potentiometer or a similar component, to arrange the individual wiper fingers, which usually consist of very small round wires made from a suitable noble metal, in groups so that gaps or spacings result between the separate wiper finger groups, which gaps or spacings may, for example, be as wide as the adjacent wiper finger groups as such. These gaps offer abraded matter and scuff an excellent possibility to settle without interfering notably with the operating of the potentiometer.

Figure 3:
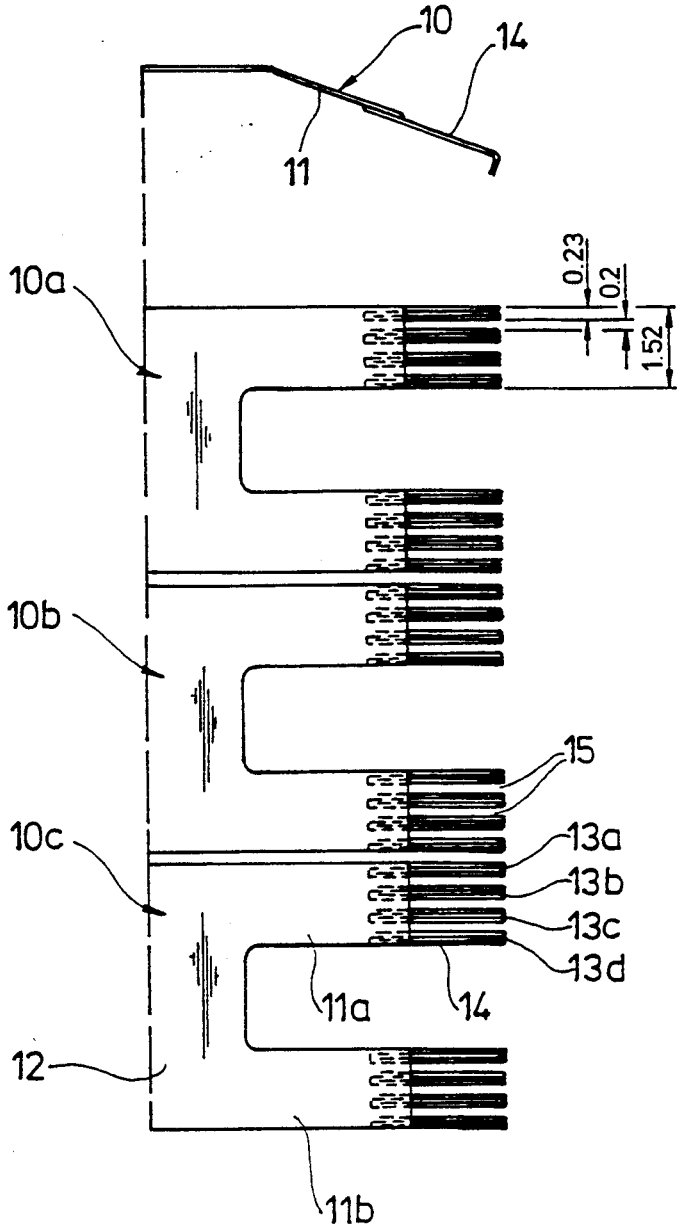
FIG. 3 shows a top view of a plurality of separate U-shaped wiper finger carrier elements, where each leg of the U-shape supports groups of spaced wiper fingers.

FIG. 3 shows, in greatly enlarged representation, U-shaped intermediate carriers 10*a*, 10*b*, 10*c* whose two legs 11*a*, 11*b* are connected to a single piece, and consequently in an electrically conductive manner, by a base element 12, the wiper fingers being fixed at the ends of the legs in a suitable way, preferably and for example by spot welding.

The arrangement is such that the different wiper fingers belonging to one wiper area are arranged in groups; in the case of the embodiment illustrated in FIG. 3, a wiper area may be formed, for example, by each end of each leg 11*a*, 11*b* of the U-shaped intermediate carrier.

In the case of the illustrated embodiment, for example, four groups 13*a*, 13*b*, 13*c* and 13*d* each containing—again related to the present embodiment—three immediately adjacent separate wiper fingers 14 are formed on each end of the leg. In any case, the arrangement of the wiper fingers in each wiper area is such that a number of fingers are arranged in parallel one adjacent the other and in mechanical frictional contact, and that the group is then followed by a gap which may, for example, have the same width as the before-mentioned wiper finger group. This gap—generally indicated by reference numeral 15 in FIG. 3—is then followed, if desired immediately, by another group of wiper fingers containing preferably the same number of individual wiper fingers 14.

This results in a preferred distribution of wiper fingers for each wiper area insofar as the desired effect, namely mechanical intrinsic damping of the wiper fingers one relative to the other, is maintained because the movement of the wiper fingers of one group is damped by the relative frictional contact, while at the same time a given number of wiper fingers is followed by a larger gap serving to receive abraded matter and scuff but also to ensure that certain uncontrolled movements of individual wiper fingers will not affect—due to their arrangement in parallel and in frictional contact—the entirety of all wiper fingers but that any such uncontrolled movements will be limited to that particular group of wiper fingers in which they arise. In other words, this means that the remaining groups of wiper fingers continue to remain in perfect contact with the respective runway on which they slide—a fact which also results in an improvement of both the mechanical running properties and the electric transmission characteristics of the wipers.

In the case of the embodiment illustrated in the drawing, each end of each leg of a U-shaped intermediate carrier comprises four groups 13*a*, 13*b*, 13*c*, 13*d* of three individual wiper fingers 14, which means that each wiper area comprises a total of twelve wiper fingers forming between them spacings and, simultaneously, groups.

Such a wiper finger area may be defined as tap means for a given resistance path or collector path, in which case the other leg, which is connected to the first leg via the base of the U-shaped intermediate carrier, constitutes another wiper area which then slides, correspondingly, on an associated collector path or resistance path.

Consequently, a potentiometer may have only one such U-shaped intermediate carrier, fixed to a movable tap, whose wiper fingers provided on the respective ends of its legs then slide along the resistance path and the collector path, thereby transmitting the tapped potential from the resistance path to the collector path.

Figure 1:
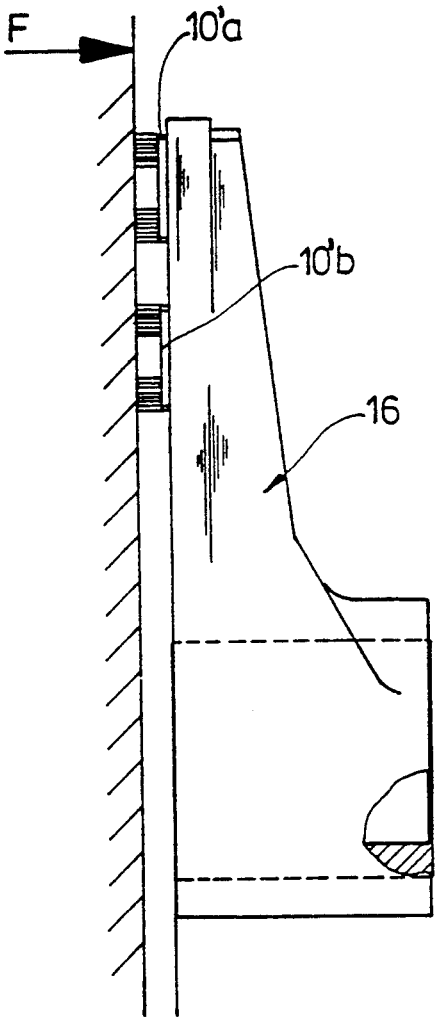
FIG. 1 shows a side view of a possible configuration of a wiper where individual wiper fingers project from the wiper and slide on an associated runway (resistance path, collector path)
Figure 2:
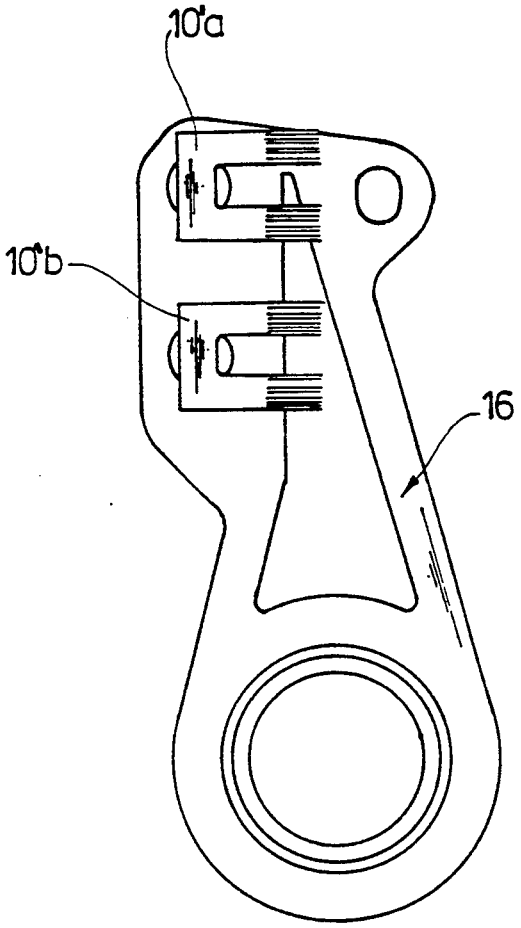
FIG. 2 shows the same wiper, viewed in the direction of arrow F in FIG. 1.

On the other hand, it is also possible to equip a tap 16—as shown in FIGS. 1 and 2—for example with two such U-shaped intermediate carriers, in which case either the legs of both such intermediate carriers—carrying the groups of wiper finger carriers—slide on a total of two resistance and two corresponding collector paths, or one of the U-shaped intermediate carriers is used in its entirety to slide on the resistance path, while the other one serves to tap or contact the corresponding collector path, the electric connection between the two U-shaped intermediate carriers 10*a*', 10*b*' at the tap 16 being established in a suitable way be connection of the two U-shaped intermediate carriers, or by the tap 16 as such.

The U-shaped intermediate carriers 10*a*, 10*b*, ... preferably consists of an electrically conductive elastically resilient material and may be bent off in the way illustrated in the side view of the U-shaped intermediate carrier 10, above the intermediate carriers 10*a*, 10*b*,... It can also be seen in this figure that the respective individual wiper fingers 14 are mounted on the end portion of each leg 11*a*, 11*b* so as to overlap such end portion by a predetermined length.

The representation of FIG. 3 shows a wiper of the scraper type, where the bent-off end portion of the wiper slides on the associated runway, i.e. the resistance path or the collector path; however, the invention is equally suited for skid-type wipers where the wiper finger slides on the runway by its bending radius 17, so to say in reverse orientation (FIG. 3). Since, given the miniature configuration of the individual wiper fingers, neither the latter nor the spacings between them can be seen with the naked eye, some dimensions intentionally have been indicated in the representation of FIG. 3 which show that the entire width of a wiper area may be in the range of 1.5 mm, the width of three wiper fingers combined to a wiper finger group may be in the range of 0.23 mm, and the distance between the individual groups may be in the range of 0.2 mm. These figures are, however, only true for the illustrated embodiment to which the invention is of course not limited.

Figure 4:
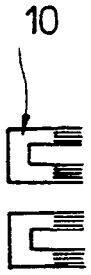
FIG. 4 shows—for the sake of better understanding U-shaped wiper finger carriers in only twice their natural size.

Such wiper finger structures can be produced with high precision by suitable automatic machines, and as the abraded matter and scuff generated in operation of such potentiometers and corresponding systems is also relatively small, the spacings provided according to the invention between the wiper finger groups of each wiper finger area are also perfectly sufficient to fulfill their task. FIG. 4 shows, still on the basis of the above-mentioned dimensional ranges and still enlarged by the factor two compared with reality, two adjacent U-shaped intermediate carriers with wiper fingers mounted thereon by spot welding so that one can get an idea of the real size.

Thus, the essential aspects of the present invention are to be seen not only in the gaps formed between groups of wiper fingers, which enable such groups to be separated one from the other as regards the mechanical damping properties ensured by their parallel adjacent arrangement, and which provide the possibility to accommodate abraded matter without the risk of functional trouble, but also in the fact that on the one hand the same good tapping characteristics are maintained while on the other hand the service life can be considerably increased, maybe even doubled, with only half the number of wiper fingers that were required heretofore in order to ensure the same function. This leads to further considerable savings in cost.

We claim:

1. A movable tap for rotary and linear potentiometers, adjustable rheostats, or the like, preferably for rapidly moving potentiometers for use in control technology, for transmission of potentials or currents from resistance and/or collector paths moving relative to the tap, comprising:

an intermediate carrier and a plurality of separate parallel wipers in one-to-one correspondence with said paths and each contacting a different path, at least one of said plurality of wipers being formed by a predetermined number of wiper fingers arranged in groups relative to each other in a manner such that a number of wiper fingers consituting a first group are arranged closely adjacent each other in the longitudinal direction, and are followed laterally by a gap or spacing approximately as wide as said first group of wiper fingers; and said gap or spacing is then again followed by a second group of wiper fingers, so as to form in said at least one wiper at least one gap which is delimited by wiper fingers on both sides.

2. A movable tap according to claim 1, wherein said groups of wiper fingers are carried by an end portion of a first leg of a U-shaped intermediate carrier on which they are fixed by spot welding; and said U-shaped intermediate carrier is fixed on said movable tap.

3. A movable tap according to claim 1 comprising:

additional groups of wiper fingers in said wiper;

each of said additional groups having approximately the same predetermined number of wiper fingers as said first group; and each of said additional groups being separated from an adjacent group by additional gaps, said additional gaps are approximately the same width as said first group of wipers fingers.

4. A movable tap according to claim 3, wherein each of said groups of wiper fingers comprises three wiper fingers which are arranged closely one beside the other and in mechanically damping contact.

5. A movable tap according to claim 3 wherein said wiper comprises at least four groups of wiper fingers.

6. A movable tap according to claim 4 further comprising:

a second one of said plurality of wipers, said second wiper contacting a different path than said at least one wiper; and a configuration of wiper fingers in said second wiper which is substantially identical to the configuration of wiper fingers in said at least one wiper.

* * * * *